US007124975B2

(12) United States Patent
Richardson

(10) Patent No.: US 7,124,975 B2
(45) **Date of Patent: *Oct. 24, 2006**

(54) CORD ORGANIZER AND METHOD OF USING THE SAME

(76) Inventor: Ron Richardson, 1143 Reader Crescent NE, Calgary, Alberta (CA) T2E 5J8

( * ) Notice: Subject to any disclaimer, the term of this patent is extended or adjusted under 35 U.S.C. 154(b) by 156 days.

This patent is subject to a terminal disclaimer.

(21) Appl. No.: 10/805,058

(22) Filed: Mar. 22, 2004

(65) Prior Publication Data

US 2005/0205711 A1 Sep. 22, 2005

(51) Int. Cl.
*B65D 63/00* (2006.01)

(52) U.S. Cl. ..... 242/402; 242/588; 24/16 R; 24/16 PB

(58) Field of Classification Search ..... 242/402, 242/405.1, 405.2, 588; 24/16 R, 16 PB
See application file for complete search history.

(56) References Cited

U.S. PATENT DOCUMENTS

| | | | | |
|---|---|---|---|---|
| 1,350,718 | A | 8/1920 | Gaines | |
| 1,916,937 | A | 7/1933 | Schlaburg | |
| 3,006,674 | A | 10/1961 | Becker | |
| 3,851,979 | A | 12/1974 | Becker | |
| 3,924,819 | A | 12/1975 | Lapinskas | |
| 4,552,481 | A | 11/1985 | Bluett | |
| 4,778,125 | A * | 10/1988 | Hu | 242/405.2 |
| 4,780,935 | A | 11/1988 | Palombit | |
| 4,991,265 | A | 2/1991 | Campbell et al. | |
| 5,075,934 | A | 12/1991 | Osedo | |
| 5,560,564 | A | 10/1996 | Maynard | |
| 5,581,850 | A | 12/1996 | Acker | |
| 5,729,872 | A | 3/1998 | Ginocchio | |
| 5,881,436 | A | 3/1999 | Lyons | |
| 6,101,684 | A | 8/2000 | Ginocchio | |
| 6,158,095 | A * | 12/2000 | Lassiter | 24/339 |
| 6,185,791 | B1 * | 2/2001 | Khokhar | 24/16 PB |
| 6,499,199 | B1 | 12/2002 | Frazier | |
| 6,523,229 | B1 | 2/2003 | Severson | |
| 2003/0066169 | A1 * | 4/2003 | Liu | 24/16 PB |

* cited by examiner

*Primary Examiner*—John Q. Nguyen
(74) *Attorney, Agent, or Firm*—Bay Area Patent Group, LLC

(57) ABSTRACT

A cord organizer and method of using the same is provided. The cord organizer is used for storing, handling and transporting cords or the like, such as electrical extension cords. The cord organizer includes a base for coiling a cord around by forming successive loops of the cord about the base. A flexible strap is provide for securing the coiled cord onto the cord organizer and to secure the individual loops of the coil to prevent the loops from becoming entangled during transportation or storage. In alternate embodiments, the base of the organizer is telescopic to be adjustable in length, cord end clips are provided to restrain free movement of the cord ends, means to positively lock the base is provided and a latch to releasably secure the strap within the slot is provided. An extension cord can also be provided having an integrally molded cord adaptor for attachment to a cord end clip. In addition, a method of using the cord organizer is also provided.

11 Claims, 3 Drawing Sheets

CORD ORGANIZER AND METHOD OF USING THE SAME

BACKGROUND OF THE INVENTION

The present invention relates generally to organizing a cord. More particularly, relating to organizing and storing a coiled cord, such as an electrical extension cord so that the cord does not become entangled.

Storing or handling cords, such as electrical cords can be a tedious and frustrating task. This is especially true when the cord is of great length and must be coiled to facilitate the transport, handling or storing of the cord. Typically, the cord is coiled into many loops and then bundled together by either attaching a tie wrap or the like or even by wrapping one end of the cord about a mid point of the coil in an attempt to secure the coil and prevent unraveling. The mere looping of the cord into a coil itself presents a challenge of trying to coil the cord without overlapping and crisscrossing successive loops that can result in entanglement of the cord and present a tedious task of detangling the cord before use. In addition, the loops of coiled cords tend to migrate together with out restraint, which often results in entanglement of the cord.

In addition to the challenges presented in coiling a cord and retaining the cord in a coiled configuration, challenges are presented in maintaining the ends of the cords free from damage and entanglement with the coil. Quite frequently, the ends of a cord will become damaged in transport, handling or storage because the ends are not restrained from free movement resulting in the ends becoming damaged from colliding with objects. To prevent damage to the ends resulting from the ends being free of restraint is has become a common practice to interweave the ends of the cord through the loops of the coiled cord to restrain the movement of the ends. While this had been proven to be effective in minimizing damaged cord ends, the interweaving of the ends into the coil leads to entanglement of the coiled cord.

Therefore, a need exists for a new and improved cord organizer and method of using the same that can be used for aiding in the act of coiling a loose cord for maintaining a cord in a coiled configuration and free from entanglement, and for restraining free movement of the ends of the cord. In this regard, the present invention substantially fulfills this need. In this respect, the cord organizer and method of using the same according to the present invention substantially departs from the conventional concepts and designs of the prior art, and in doing so provides an apparatus primarily developed for the purpose of providing for a cord organizer that facilitates easy coiling of a cord, maintains the cord in a coiled configuration and prevents damage to the ends of the cord.

SUMMARY OF THE INVENTION

In accordance with the present invention, a cord organizer and method of using the same is provided. In a preferred embodiment, the cord organizer essentially includes a base having a first end and a second end. A strap having one end attached to the first end of the base with the second end of the strap free from permanent attachment. A slot is formed through the second end of the base and the second of the strap is adapted to be securely received by the slot. In use, a cord is looped around the base to create a coil, which is then secured from movement by passing the free end of the strap through the slot so that the strap engages the loops of the coil and restrains the loops from moving, thereby preventing entanglement.

In additional embodiments the base may be adjustable in length to accommodate a wide range of cord lengths, cord end clips may be provided, and a latch for releasably securing the second end of said strap in the slot may be provided.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
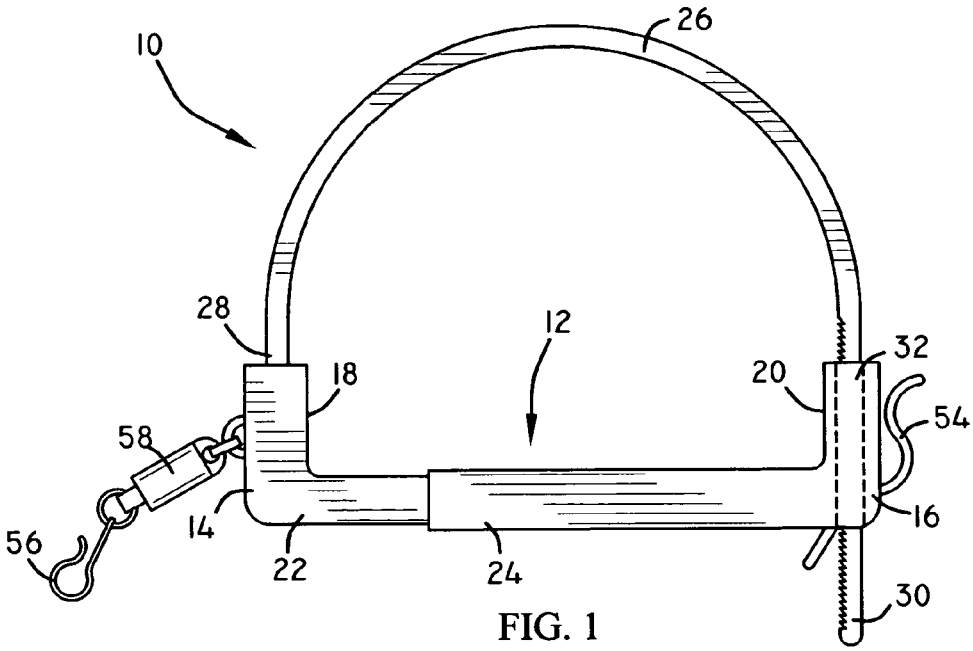
FIG. 1 is a side elevation view of the preferred embodiment of the cord organizer constructed in accordance with the principles of the present invention.
Figure 2:
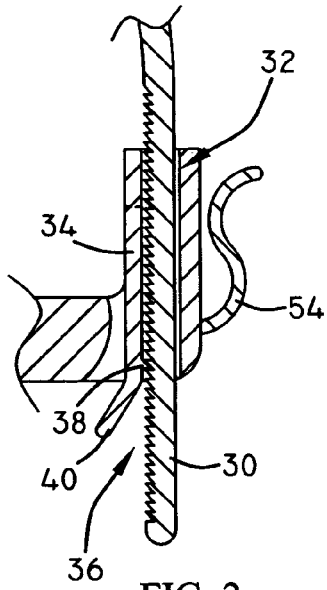
FIG. 2 is a cross sectional view of the cord organizer taken through the slotted end illustrating the engagement of the strap with the base.
Figure 3:
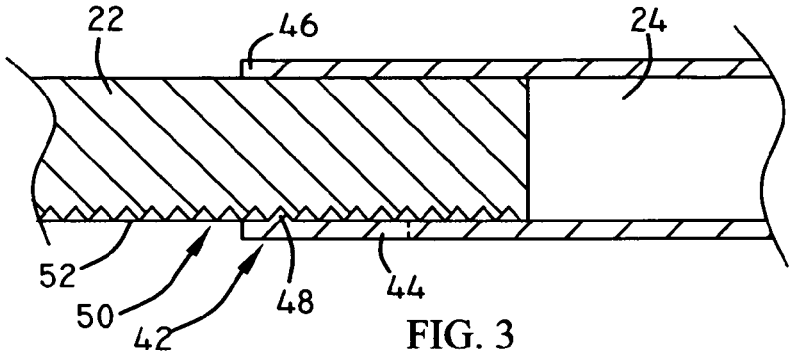
FIG. 3 is a cross sectional view of the cord organizer taken through the base thereof.

Referring now to the drawings, and particularly to FIGS. 1–3 a preferred embodiment of the cord organizer of the present invention is shown and generally designated by the reference numeral 10. The cord organizer 10 includes a base 12 having a first L-shaped end 14 and an opposed second L-shaped end 16 with the long side of each end 14 and 16 being coplanar and the short side of each end extending from a common surface 15. Preferably, the short sides of ends 14 and 16 extended perpendicularly from the base 12 to provide facing sidewalls 18 and 20 to prevent a cord coiled around the base from slipping off of the ends of the base. The base 12 can include a first base member 22 that defines the first L-shaped end 14 and a second base member 24 that defines the second L-shaped end 16. The first base member 22 is telescopically received by the second base member 24 along the long sides of each L-shaped end 14 and 16. The first base member 22 can be slid into and out of the second base member 24 to adjust the length of the base 12 to accommodate cords of various lengths. The first base member 22 can be in frictional engagement with the second base member 24. Preferably, the base 12 includes a positive locking means, described in detail below, for releasably securing the first base member 22 to the second base member 24 so as to prevent inadvertent adjustment of the length of the base.

A flexible strap 26 is attached at a first end 28 to the end of the short side of the L-shaped end 14 and extends upwardly therefrom with the second end 30 of the strap free from permanent attachment and being is adapted to be securely received by a slot 32 formed longitudinally through the short side of the second L-shaped end 16 of the base 12.

Turing to FIG. 2, which is a cross section taken through the second end 16 of the base 12. The second end 30 of the strap 26 can be retained within the slot by frictional engagement with a latch 34. Preferably, a plurality of female pawl elements 36 are formed into the strap 26 and a male pawl element 38 is formed into the latch 34, which is received by an adjacent female pawl element to secure the second end 30 of the strap within the slot 32. Most preferably, the latch 34 includes a lever 40, which when pulled in a direction away from the strap will disengage the male pawl element 38 from the female pawl elements 36 so that the strap is free to be pulled out from the slot 32. In addition, the latch 34 can be integrally formed with the base 12. Even more preferably, the female pawl elements 36 are upwardly faced so that the second end 30 of the strap 26 is free to be passed through the slot 32 but is restricted from being pulled out from the slot by engagement of the male pawl element 38 with the female pawl elements.

Turning to FIG. 3, which is a cross section taken through the base to illustrate the positive locking means 42. The positive locking means 42 is for releasably securing the first base member 22 to the second base member 24 so as to prevent inadvertent adjustment of the length of the base 12. The positive locking means 42 does not require a user to manipulate a lever or any other interface to engage or disengage the means to allow the sliding of the first base member 22 relative to the second base member 24. Rather is it designed so that when a predetermined force is applied to push the first base member 22 into the second base member 24 or to pull the first base member from the second base member the positive locking means automatically disengages and then subsequently reengages.

In one example, the positive locking means 42 can include a tab 44 integrally formed with the second base member 24 towards a distal end 46 thereof. A projection 48 extends from the interior surface of the tab 44, which is received by one of a plurality of recesses 50 formed into the adjacent surface 52 of the first base member 22. The tab 44 is resilient and deflects in a direction away from the surface 52 of the first base member 22 when a large enough push-pull force is applied to the first base member, thereby disengaging the projection 48 from one recess 50 and reengaging the projection in an adjacent recess. Preferably, the projection 48 is of a generally triangular shape and the recesses 50 are of a generally triangular cross-section.

Turning back to FIGS. 1 and 2, the cord organizer 10 can also include a cord retaining clip 54 attached to the base 12 for securing the end of a cord to the base. A cord retaining clip 54 can be attached to either side of the base 12 or can be attached to only one side of the base. Preferably, the cord retaining clip 54 is integrally formed with the base 12 and is resilient.

A cord coupling clip 56 can also be provided for securing an end of a cord to the cord organizer 10. Preferably, the cord coupling clip 56 is constructed from a resilient material and is removably attached to the cord organizer 10 at the base 12 by a swivel connector 58. Ideally, the cord coupling clip 56 is used to secure the male connection end of a cord and the swivel connector 58 allows for the end to be easily positioned to be inserted into an electrical outlet without requiring the removal of the end from the cord coupling clip. Most preferably, a cord adaptor 60 is provided which is clamped to the end of the cord and the cord coupling clip 56 clips to the cord adaptor. The addition of the cord adaptor 60 prevents the cord coupling clip 56 from wearing the surface of the cord from repeated attachment and detachment. In addition, the cord adaptor 60 provides for a non-slip attachment of the cord coupling clip 56 to the end of a cord.

Figure 2A:
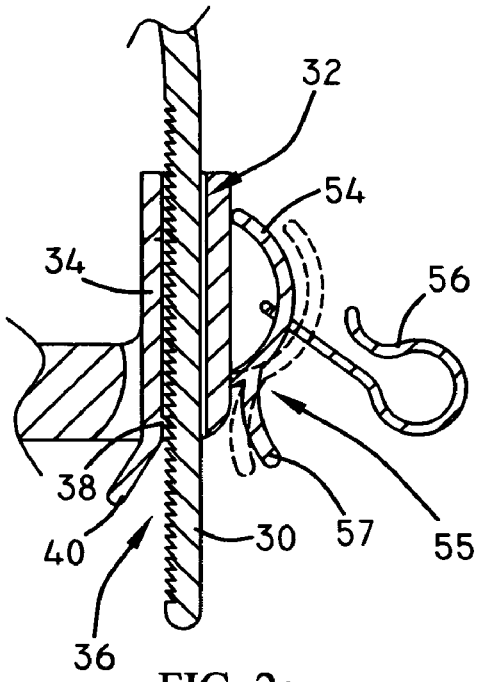
FIG. 2*a* illustrates an alternate embodiment of a cord retaining clip.

Referring to FIG. 2*a* which illustrates an alternate embodiment of the cord retaining clip 54. In this embodiment, the cord retaining clip 54 in pivotally attached at point 55 to the end 16 of the base 12 and includes a lever 57 to facilitate the opening of the clip. The cord retaining clip 54 is constructed from a resilient material having a high fatigue rating so that the clip can withstand repeated flexing without failure. In this embodiment, as like the embodiment illustrated in FIG. 2, a cord coupling clip 56 could be secured to the cord end retaining clip 54 and can be used in conjunction with a cord adaptor 60 to secure an end of a cord to the side 16 of the cord organizer 10.

Figure 4:
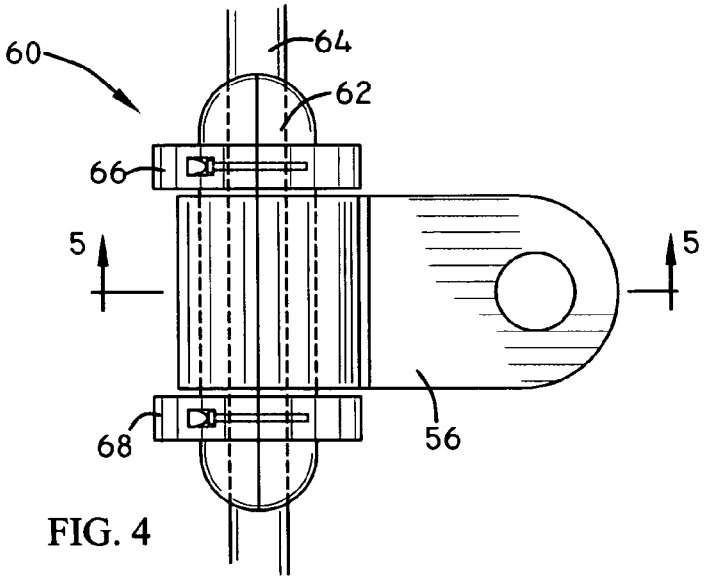
FIG. 4 is a top plan view of the cord coupling clip attached to the cord end adaptor.
Figure 5:
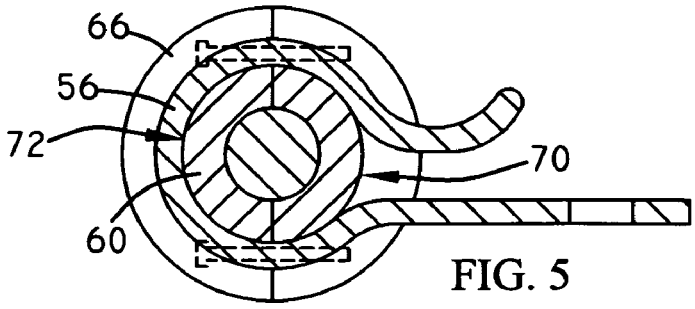
FIG. 5 is a cross sectional view taken along line 5—5 in FIG. 4.

Turning to FIGS. 4 and 5, the cord adaptor 60 is generally cylindrical in shape and is of a two-piece construction. A longitudinal bore 62 is formed into the cord adaptor 60 for receiving a length of cord 64 therein, which is securely clamped between the two halves of the cord adaptor. Once the cord adaptor 60 is clamped to the length of cord it will not slide along the cord and provides for a non-slip attachment point for the cord coupling clip 56. The cord adaptor 60 can also include raised edges 66 and 68 which act as restraint walls to preclude the cord coupling clip 56 from sliding off the ends of the cord adaptor 60. Preferably, the exterior diameter 70 of the cord adaptor 60 is slightly greater then interior diameter 72 of the cord coupling clip 56 so as to provide a tight interfitment so that the cord coupling clip not prone to slipping off the cord adaptor.

Figure 6:
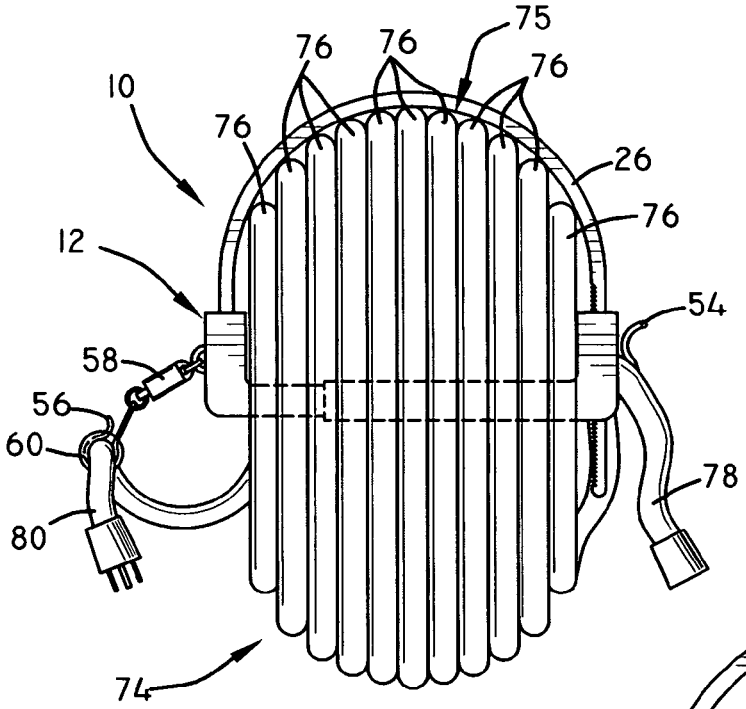
FIG. 6 is a side elevation view of the cord organizer in use.

Turning to FIG. 6, the cord organizer 10 is illustrated in use holding a coiled cord 74 with the loops 76 of the cord securely retained to the cord organizer between the base 12 and the strap 26. One end 78 of the cord 74 is attached to the cord organizer 10 by a cord retaining clip 54 and the opposite end of 80 of the cord is attached to a cord coupling clip 56.

Figure 7:
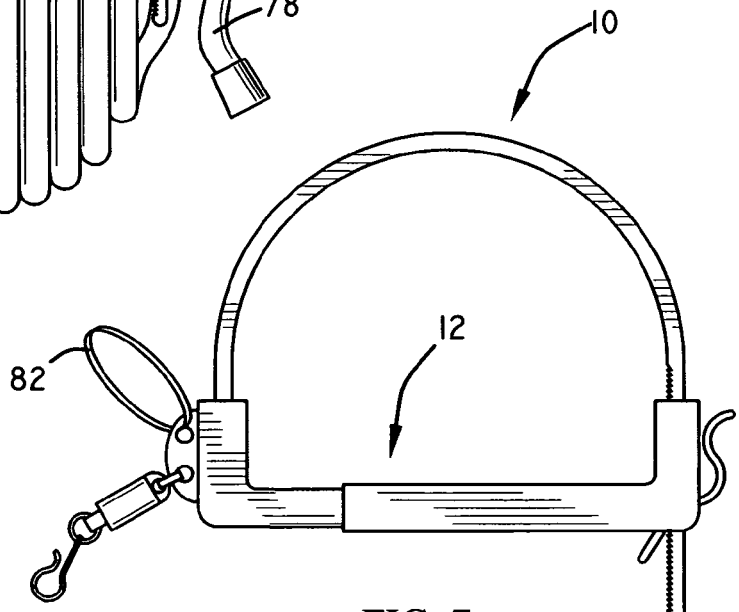
FIG. 7 is a side elevation view of an alternate embodiment of the cord organizer of the present invention.

Referring to FIG. 7, an alternate embodiment of the cord organizer 10 is illustrated. In this embodiment, a handle 82 is attached at one end of the base 12 which can be used to either carry or hang the cord organizer 10.

Figure 8:
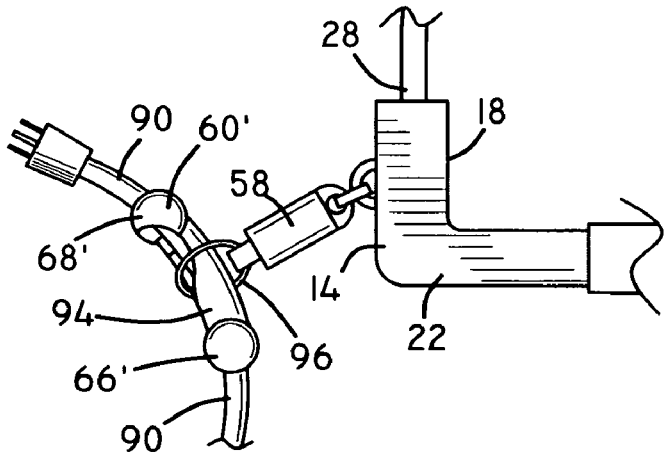
FIG. 8 is a side elevation view of an alternate embodiment of the cord organizer of the present invention.

Turning now to FIG. 8, an alternate embodiment of the cord organizer 10 is illustrated. In this embodiment, an extension cord 90 is provided with a cord adaptor 60' integrally molded into a section of the cord. Preferably, the cord adaptor 60' is integrally molded into the cord 90 towards an end 92 thereof. The cord adaptor 60' includes two enlarged ends 66' and 68', and a longitudinal center section 94 which is of a diameter greater then the diameter of the cord 90. In this embodiment, a cord coupling clip 56 (not shown) or a ring 96 can be secured around the longitudinal center section 94 to secure the cord 90 to the cord organizer 10. The longitudinal section 94 prevents a cord coupling clip 56 or a ring 96 from damaging the cord 90.

In use, it can now be understood that a loose cord is looped around the base 12 of the cord organizer 10 so that the cord is coiled around the base with sides of adjacent loops in abutment. The second end 30 of the strap is inserted into the slot 32 and pulled therethrough so that the strap engages the surface of each outward most loop, thereby securely retaining the loops of the coiled cord in place and securing the coiled cord to the cord organizer 10. If the base 12 of the cord organizer is adjustable, after the strap 26 is secured by inserting the second end 30 thereof into the slot 32, the base is adjusted so that the loops of the coiled cord are pressed together so that the surface of each outward most loop of the coiled cord abuts and presses into the strap and forms and acruate path 75 therewith. Once the cord is secured to the cord organizer 10, the loops of the coil will not migrate and will mantain the coiled cord free from entanglement. In addition, the ends of the cord can be attached either to a cord end clip 54 or a cord adapter 60 can be secured to the end of a cord and then clipped to a cord coupling clip 56 so that the ends of the cords are restrained from movement.

While a preferred embodiment of the cord organizer and method of using the same has been described in detail, it should be apparent that modifications and variations thereto are possible, all of which fall within the true spirit and scope of the invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cord organizer comprising:

a base having opposed first and second L-shaped ends, wherein the long side of each of said first and said second L-shaped ends are coplanar and wherein the short side of each of said first and said second L-shaped ends extend from a common side of said base;

a slot formed longitudinally through said short side of said second end;

a strap having a first end attached to and extending from the end of said short side of said first end of said base, and a second, free end adapted to slide through said slot; and a latch operable to releasably secure said second end of said strap in said slot.

2. The cord organizer of claim 1, wherein said base includes a first base member including said first L-shaped end and a second base member including said second L-shaped end, said first base member being telescopically interconnected to said second base member along said long sides of each of said first and said second L-shaped ends.

3. The cord organizer of claim 2, wherein said first base member is frictionally received within said second base member.

4. The cord organizer of claim 1, wherein said strap includes a plurality of female pawl elements along said second end thereof; and wherein said latch includes a male pawl element for engaging one female pawl element of said plurality of female pawl elements to secure said second end of said strap in said slot, and a lever for releasing said male pawl element from said female pawl element.

5. The cord organizer of claim 1, further comprising:

a resilient cord retaining clip integral with said base.

6. The cord organizer of claim 1, further comprising:

a cord coupling clip removably attached to said base; and a cord end adaptor having opposed raised edges, said cord end adaptor for attachment to a cord and adapted to be received by said cord coupling clip.

7. A cord organizer comprising:

a base comprising of a first L-shaped base member and a second L-shaped base member being telescopically interconnected along the long sides of each of said first and said second L-shaped base members, and wherein the short side of each of said first and said second L-shaped base members extend from a common side of said base, said short side of said second base member defining a slot formed longitudinally therethrough;

a strap having a first end attached to and extending from the end of said short side of said first base member, and a second, free end adapted to slide through said slot, said second end of said strap including a plurality of female pawl elements; and a latch including a male pawl element for engagement with one female pawl element of said plurality of female pawl elements to releasably secure said second end of said strap in said slot and a lever for releasing said male pawl element from said female pawl element.

8. The cord organizer of claim 7, further comprising:

a cord coupling clip removably attached to said base; and a cord end adaptor of a generally cylindrical shape including a longitudinal bore for receiving a length of cord and including opposed radially extending raised edges, said cord end adaptor being of a two piece construction and being fixedly clamped to the length of cord; and wherein said cord coupling clip is attachable to said cord end adaptor between said raised edges.

9. The cord organizer of claim 7, further comprising:

a cord retaining clip of a resilient material pivotally attached to said second L-shaped base member and including a lever to facilitate the opening of said cord retaining clip.

10. The cord organizer of claim 7, wherein said long side of said first L-shaped base member is frictionally received within said long side of said second L-shaped base member.

11. The cord organizer of claim 10, further comprising:

a positive locking means for releasably securing said first L-shaped base member to said second L-shaped base member to prevent inadvertent adjustment of the length of said base.

* * * * *